US008529052B2

(12) United States Patent
Chiwata

(10) Patent No.: US 8,529,052 B2
(45) Date of Patent: Sep. 10, 2013

(54) PAPER SEASONING APPARATUS, PAPER SEASONING METHOD, INKJET RECORDING APPARATUS

(75) Inventor: Yuhei Chiwata, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 300 days.

(21) Appl. No.: 13/170,199

(22) Filed: Jun. 28, 2011

(65) Prior Publication Data

US 2011/0316950 A1 Dec. 29, 2011

(30) Foreign Application Priority Data

Jun. 28, 2010 (JP) ..... 2010-146594

(51) Int. Cl.
*B41J 2/01* (2006.01)

(52) U.S. Cl.
USPC ..... 347/102

(58) Field of Classification Search
USPC ..... 347/102
See application file for complete search history.

(56) References Cited

FOREIGN PATENT DOCUMENTS

JP 2008-290800 A 12/2008

*Primary Examiner* — Stephen Meier
*Assistant Examiner* — Tracey McMillion
(74) *Attorney, Agent, or Firm* — SOLARIS Intellectual Property Group, PLLC

(57) ABSTRACT

The present invention provides a paper seasoning apparatus, a paper seasoning method, and an inkjet recording apparatus, that may improve seasoning achieved by blowing air against a paper stack. A paper seasoning apparatus includes, an upwards protruding shaped mounting surface on which a paper stack is mounted, and first air blowing devices and second air blowing devices that blow air against a side face of the paper stack mounted on the mounting surface. The second air blowing devices are disposed in the vicinity of a maximum height position and at a height of a position where air outlets of the second air blowing devices include the mounting surface.

14 Claims, 10 Drawing Sheets

PAPER SEASONING APPARATUS, PAPER SEASONING METHOD, INKJET RECORDING APPARATUS

CROSS-REFERENCE TO RELATED APPLICATION

This application claims priority under 35 USC 119 from Japanese Patent Application No. 2010-146594 filed on Jun. 28, 2010, the disclosure of which is incorporated by reference herein.

BACKGROUND

1. Technical Field

The present invention relates to a paper seasoning apparatus, a paper seasoning method and an inkjet recording apparatus. In particular, the present invention relates to a paper seasoning apparatus for blowing air onto a side face of a stack of paper, a paper seasoning method employing such a paper seasoning apparatus, and an inkjet recording apparatus including the paper seasoning apparatus.

2. Related Art

Sometimes expansion and contraction of paper occurs just after the paper has been recorded with an image by an inkjet recording apparatus. This expansion and contraction of paper are due to the presence of portions within a single sheet of paper, where there is a lot of ink (moisture content) and portions where there is little thereof.

Japanese Patent Application Laid-Open (JP-A) No. 2008-290800 discloses a paper handling apparatus that includes a pair of pressing members that sandwich plural sheets of paper that have been stacked on each other from the front and back, and air supply devices and air supply nozzles that blow air onto the sandwiched plural sheets of paper.

Humidity conditioning (called seasoning) of the paper, namely acclimatization of the paper to the peripheral environment, in particular to the humidity, can be performed by supplying air onto the plural sheets of paper (paper stack), thereby suppressing expansion and contraction of the paper.

However, a mounting plate may have a curve with a specific radius of curvature in order to correct paper curl, when paper is collected and stacked in the vertical direction and the stack of paper sheets mounted on a mounting plate. When a mounting plate has a curve in such a manner and air is blown between sheets of paper similarly to in JP-A No. 2008-290800, sufficient separation between the sheets of paper cannot be secured. This is due to concentration of the load of the paper, for example, in the vicinity of a peak of the mounting plate (a location of locally raised height). Accordingly, there is a need for more efficient humidity conditioning (seasoning).

SUMMARY

The present invention provides a paper seasoning apparatus, a paper seasoning method employing the paper seasoning apparatus, and an inkjet recording apparatus including the paper seasoning apparatus, that may improve effectiveness of seasoning by blowing air against a stack of paper.

A first aspect of the present invention is a paper seasoning apparatus including: a mounting plate including a curved mounting face on which a paper stack is mounted; a plurality of first air blowing sections that blow air against a side face of the paper stack mounted on the mounting face from a direction orthogonal to the curved direction of the mounting face; and a plurality of second air blowing sections that have an air blowing range shorter in the height direction than the first air blowing sections, and that blow air to the vicinity of maximum height position(s) of the mounting face.

In this paper seasoning apparatus, the mounting face of the mounting plate on which the paper stack is mounted is curved, to configure a maximum height position where the local height is raised. Due to the plural first air blowing sections being provided and blowing air against the side face of the paper stack in a direction orthogonal to the curved direction of the mounting plate, air may be blown between the sheets of paper, and humidity conditioning may be performed while curl is corrected, even when there is a curl initially present in the paper.

More specifically, the plural second air blowing sections are provided in this paper seasoning apparatus with an air blowing range that is shorter in the height direction than an air blowing range of the first air blowing sections. The second air blowing sections also blow air at vicinity of the maximum height position of the mounting face. A tight separation may arise between sheets of paper at the maximum height position of the mounting face and in its vicinity. However the separation between the sheets of paper can be suppressed from becoming uneven by blowing air to this area with the second air blowing sections. Accordingly, sufficient air may be blown between the sheets of paper, suppressing unevenness of moisture content from arising in the paper, and may enable an improved humidity conditioning effect to be exhibited. The paper may also be suppressed from thrashing around, since air passes between the sheets of paper in a state in which unevenness of separation between the sheets is suppressed. Note that a single second air blowing section or plural second air blowing sections may be provided as long as such an effect can be exhibited.

"The vicinity" of the maximum height position obviously includes the position of the maximum height position itself, and also includes locations where in practice the separation between the sheets of paper mounted on the mounting face becomes tightly packed due to the presence of the maximum height position, lowering the through flow of air fed from the first air blowing section.

A second aspect of the present invention, in the first aspect, the air blowing range of the second air blowing section may include the mounting face.

Accordingly, the second aspect of the present invention may ensure that air is blown onto the side face of the paper stack mounted on the mounting face.

A third aspect of the present invention, in the first or second aspect, the mounting face may be configured with a curved shape when viewed along the air blowing direction from the first air blowing sections having a central portion protruding upwards, and dropping downwards on progression towards both edge portions, to give the maximum height position at the center of the mounting plate.

A fourth aspect of the present invention, in the first or second aspect, the mounting face may be configured with a curved shape when viewed along the air blowing direction from the first air blowing sections having a central portion protruding downwards, and rising upwards on progression towards both edge portions, to give the maximum height positions at both edges of the mounting plate.

The curved shape of the mounting face may be formed with a shape that protrudes upwards at the central portion (referred to below simply as an upwards protruding shape), or with a shape that protrudes downwards at the central portion (referred to below simply as a downwards protruding shape). However, with either shape, the volume of air blown from the first air blowing sections may be made symmetrical by adopting a fifth aspect of the present invention in which the plurality of first air blowing sections are disposed symmetrically about the central portion of the mounting face as the center. Accordingly, in the fifth aspect, a nearly uniform volume of air flow between the sheets of paper across the width direction may be obtained. Similarly, the volume of air blown from the second air blowing section can be made symmetrical by adopting a sixth aspect of the present invention in which the plurality of second air blowing sections are disposed symmetrically about the central portion of the mounting face as the center. Accordingly, in the sixth aspect, a nearly uniform volume of air flow between the sheets of paper across the width direction may be obtained. Note that when only a single second air blowing section is provided, the above symmetrical distribution can be achieved by placing the second air blowing section in the center of the mounting face.

A seventh aspect of the present invention, in the third to the sixth aspects, may further include a top plate including a top face that faces the mounting face and has a curved shape similar to the mounting face.

The paper can accordingly be suppressed from unintentionally rising up and thrashing about, due to the top face of the top plate being positioned above the paper stack mounted on the mounting face. More specifically, the top face is configured with a curved shape similar to that of the mounting face. "A curved shape similar to" means that the top face is formed with an upward protruding shape when the mounting face is formed in an upward protruding shape. Further, "A curved shape similar to" means that the top face is formed with a downward protruding shape when the mounting face is formed in a downward protruding shape. Consequently, a substantially constant separation to the mounting face can be maintained compared to configurations with a top face having downward protruding shape for an upward protruding shaped mounting face, or a top face having an upward protruding shape for a downward protruding shaped mounting face, enabling the shape of the paper to be corrected.

An eighth aspect of the present invention, in the first to the seventh aspects, volume of air blown by the first air blowing section disposed at the vicinity of the maximum height position of the mounting face may be greater than the volume of air blown by the other first air blowing sections.

Since the separation between sheets of paper become tight at the maximum height position of the mounting face or in the vicinity thereof, due to the volume of air blown by the first air blowing sections in this area being greater than the volume of air blown by the other first air blowing sections, this raises the ability to suppress unevenness in separation between the sheets. Accordingly, in the above aspect, unevenness in moisture content in the paper may be suppressed, enabling an improved humidity conditioning effect to be exhibited. Moreover, in the above aspect, the paper may be suppressed from thrashing around since air is blown between the sheets of paper in a state in which unevenness of separation between the sheets is suppressed.

A ninth aspect of the present invention is a paper seasoning method that utilizes the paper seasoning apparatus of the above aspects to blow air onto a side face of a paper stack mounted on the mounting plate, wherein volume of air blown by the first air blowing section disposed in the vicinity of the maximum height position of the mounting face is set greater than the volume of air blown by the other first air blowing sections.

Since the above aspects is employed as the paper seasoning apparatus, air can be blown between the sheets of paper, and humidity conditioning may be performed while curl is corrected, even when the paper is initially curled. Since the second air blowing sections blow air at the vicinity of the peak of the mounting plate, the separation between sheets of paper may be suppressed from becoming uneven.

Furthermore, since the volume of air of the first air blowing sections disposed at the vicinity of the maximum height position of the mounting face are greater than the volume of air of the other first air blowing sections, suppression of unevenness between the sheets of paper may be performed. Accordingly, unevenness in moisture content of the paper may be suppressed, enabling an improved humidity conditioning effect to be exhibited.

A tenth aspect of the present invention is a paper seasoning method that utilizes the paper seasoning apparatus the above aspects to blow air onto a side face of a paper stack mounted on the mounting plate, wherein air starts to be blown from the first air blowing section after air blowing from the second air blowing section(s) has started.

The second air blowing sections include air blowing ranges that are shorter in the height direction that the first air blowing sections. The second air blowing sections also blow air at vicinity of the maximum height position of the mounting face. Namely, due to blowing air from a low position onto the side face of the paper stack at the vicinity of the maximum height position of the mounting face, the paper may be suppressed from curling over on itself.

In the vicinity of the maximum height position of the mounting face where there is a tendency for the separation between sheets of paper to become tight, the separation between the sheets of paper may be effectively suppressed from becoming uneven, by first blowing air onto the side face of the paper stack with the second air blowing sections.

An eleventh aspect of the invention is an inkjet recording apparatus including: an inkjet recording apparatus main body that jets ink droplets onto paper and records an image; and the paper seasoning apparatus of the above aspects provided at a discharge section for paper on which an image has been recorded by the inkjet recording apparatus main body.

Images can be recorded on the paper using the inkjet recording apparatus main body. By providing the paper seasoning apparatus of one of the above aspects at the discharge section of the inkjet recording apparatus main body, unevenness in moisture content of the paper may be suppressed, and may enable an improved humidity conditioning effect to be exhibited.

Accordingly, in the above aspects, the present invention may provide an improved humidity conditioning effect to be exhibited by blowing air onto a paper stack.

BRIEF DESCRIPTION OF THE DRAWINGS

Exemplary embodiments of the present invention will be described in detail based on the following figures, wherein.

DETAILED DESCRIPTION

Explanation follows regarding a paper seasoning apparatus 12 of a first exemplary embodiment of the present invention, and an inkjet recording apparatus 112 equipped with the paper seasoning apparatus 12.

Figure 1:
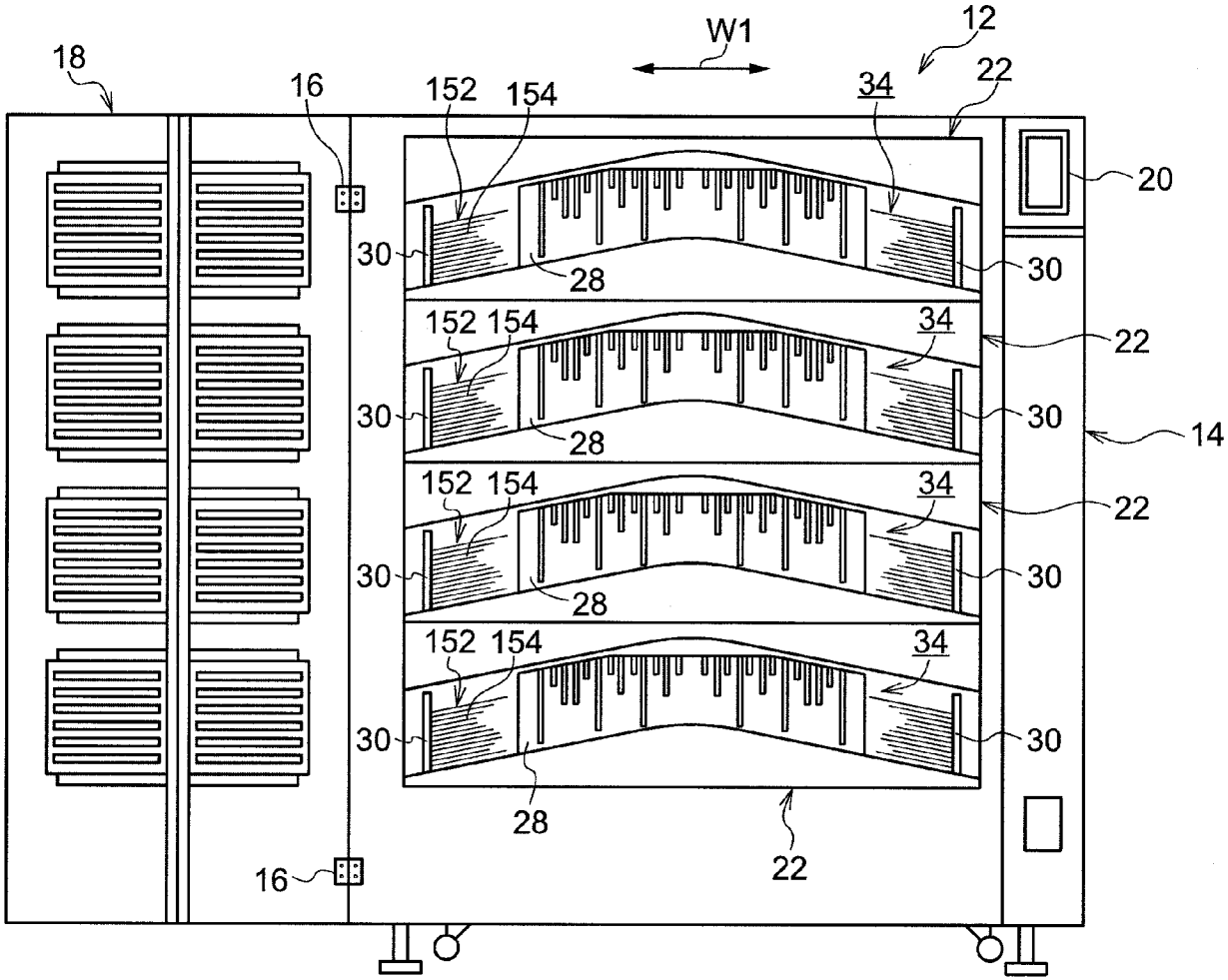
FIG. 1 is a front view illustrating a paper seasoning apparatus of the first exemplary embodiment of the present invention.

As shown in FIG. 1, the paper seasoning apparatus 12 of the present exemplary embodiment has a box shaped housing 14. The housing 14 can be opened and closed from the paper seasoning apparatus 12 front side (near side) by utilizing a front cover 18 supported by a hinge 16. FIG. 1 shows the front cover 18 in its open position, enabling inspection inside the housing 14. There is a touch panel 20 for an operator to operate the paper seasoning apparatus 12 provided at the opposite side to the hinge 16 side.

Plural (four in the present exemplary embodiment) stacking shelf units 22 are disposed in the housing 14. While four of the stacking shelf units 22 are illustrated in FIG. 1 along the vertical direction, configuration may be made with a single stacking shelf unit 22 supported by a raising and lowering support member (not shown) so as to be movable in the vertical direction.

The stacking shelf units 22 are supported by the housing 14 such that they can be pulled out by sliding towards the front when the front cover 18 is in the open state. Reference below simply to the "width direction" this means the width direction of the stacking shelf units 22 (the direction shown by arrow W1 in FIG. 1).

Figure 2:
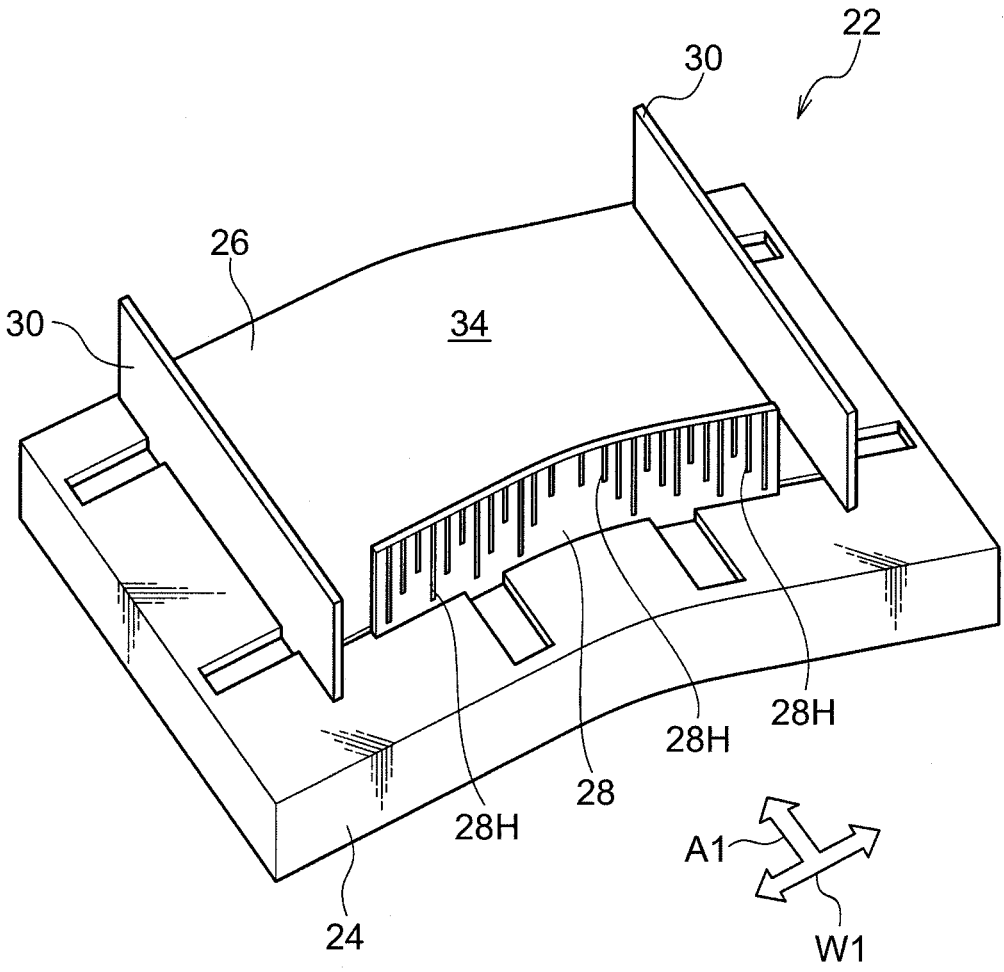
FIG. 2 is a perspective view illustrating a partial enlargement of a stacking shelf unit of a paper seasoning apparatus of the first exemplary embodiment of the present invention.
Figure 3:
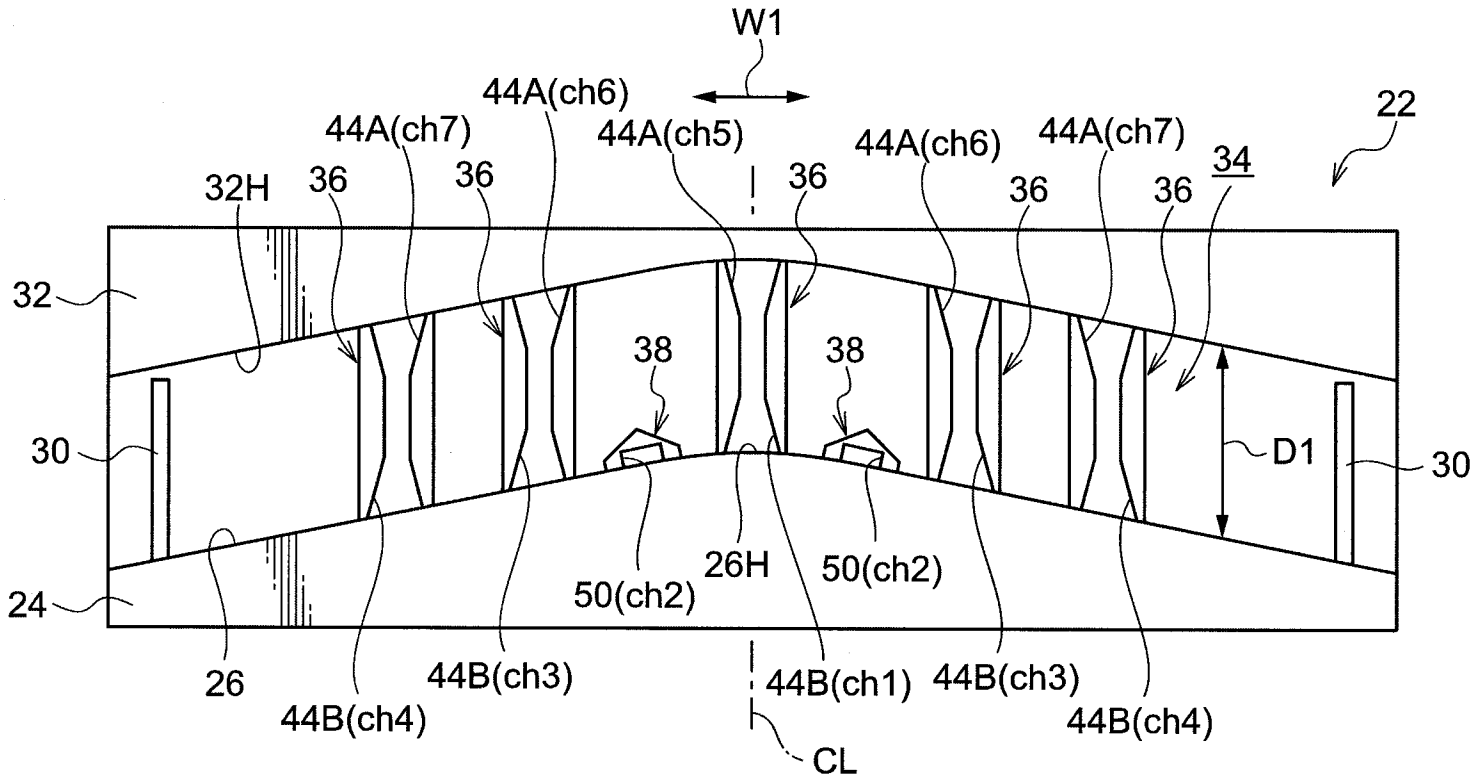
FIG. 3 is a front view illustrating a partial enlargement of a stacking shelf unit of a paper seasoning apparatus of the first exemplary embodiment of the present invention.

As shown in detail in FIG. 2 and FIG. 3, each of the stacking shelf units 22 has a mounting plate 24. The top face of the mounting plate 24 configures a mounting surface 26 on which a paper stack 152 of plural stacked sheets of paper 154 is mounted (see FIG. 1, FIG. 8A and FIG. 8B). In the present exemplary embodiment, as an example, the number of sheets of the paper 154 stackable in a single stacking shelf unit 22 is 125 sheets. Namely, the paper stack 152 is configured by up to 125 sheets of the paper 154.

The mounting surface 26 is shaped such that, when viewed from the arrow A1 direction, the width direction central portion of the mounting surface 26 is raised, and both the width direction edge portions are lowered, namely a shape protruding upwards. Curving the mounting surface 26 in this manner enables, for example, curl correction to be performed by bending the paper in a direction orthogonal to a curl direction, when the paper 154 has been recorded with an image in the inkjet recording apparatus 112 adopted a curl in a particular direction.

The radius of curvature of the mounting surface 26 is not necessarily constant across the width direction of the stacking shelf unit 22 (the arrow W1 direction), and may include a different radius of curvature at each location on the mounting surface 26. In the present exemplary embodiment, the mounting surface 26 is configured to include a constant radius of curvature at the width direction centre of the mounting surface 26, curving in an upwards protruding shape, with the height reaching a maximum height at maximum height position 26T at the width direction central portion. Both width direction sides of the maximum height position 26T are configured with sloping sections 26S that slope in substantially flat plane shapes. The maximum height position 26T is positioned at the width direction center of the mounting plate 24, with the mounting plate 24 shaped to exhibit left-right symmetry about the maximum height position 26T (shown by a center line CL) of the mounting plate 24 as the center.

A single front plate 28 and a pair of side plates 30 are provided protruding up from the mounting plate 24, enabling the edges of plural sheets of paper mounted on the mounting surface 26 of the mounting plate 24 to be aligned with each other. More specifically, the front plate 28 is movable in the arrow A1 direction and the opposite direction to the arrow A1 direction, and the side plates 30 are movable in the arrow W1 directions enabling different sizes of the paper 154 to be accommodated.

A top plate 32, as shown in FIG. 3, is disposed above the mounting plate 24 in each of the respective stacking shelf units 22. The bottom face of the top plate 32 is curved in a shape similar to the mounting surface 26 when viewed in the same direction as the arrow A1 direction of FIG. 2. Accordingly, the bottom face of the top plate 32 configures a top face 32H that faces the paper mounted on the mounting surface 26. The region surrounded by the mounting surface 26, the top face 32H, the front plate 28 and the side plates 30 configures a paper stack housing space 34.

Plural air discharge holes 28H are formed in the front plate 28 such that air that has passed between the sheets of paper 154 from a first air blowing device 36 and a second air blowing device 38 can then be let out from the paper stack housing space 34.

As shown in detail in FIG. 3, plural (five in the present exemplary embodiment) of the first air blowing devices 36 and plural (two in the present exemplary embodiment) of the second air blowing devices 38 are disposed at the far side of the mounting plate 24 (the side not disposed with either the front plate 28 or the side plates 30). The first air blowing devices 36 and the second air blowing devices 38 operate to acclimatize the paper 154 configuring the paper stack 152 to the environment around (to season) by blowing air similar to the peripheral atmosphere (in temperature and humidity) onto one of the side faces of the paper stack 152 mounted on the mounting surface 26.

Figure 4B:
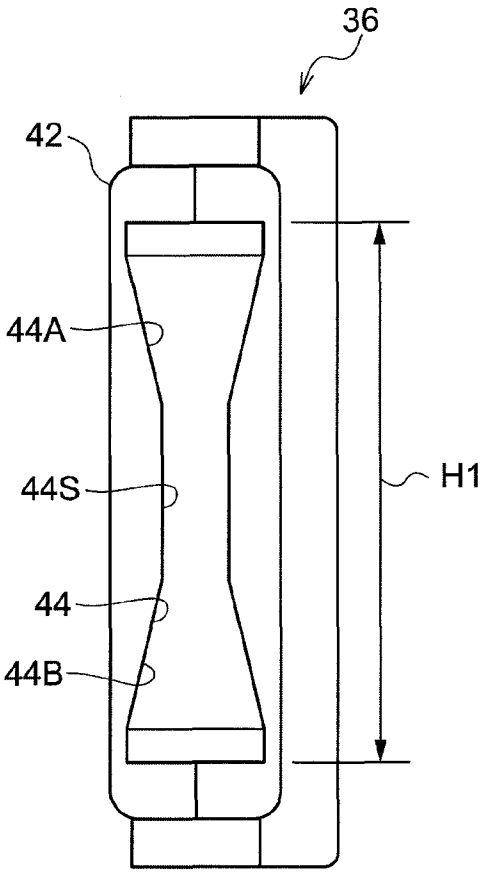
FIG. 4B is a front view of a first air blowing device employed in a paper seasoning apparatus of the first exemplary embodiment of the present invention.
Figure 4A:
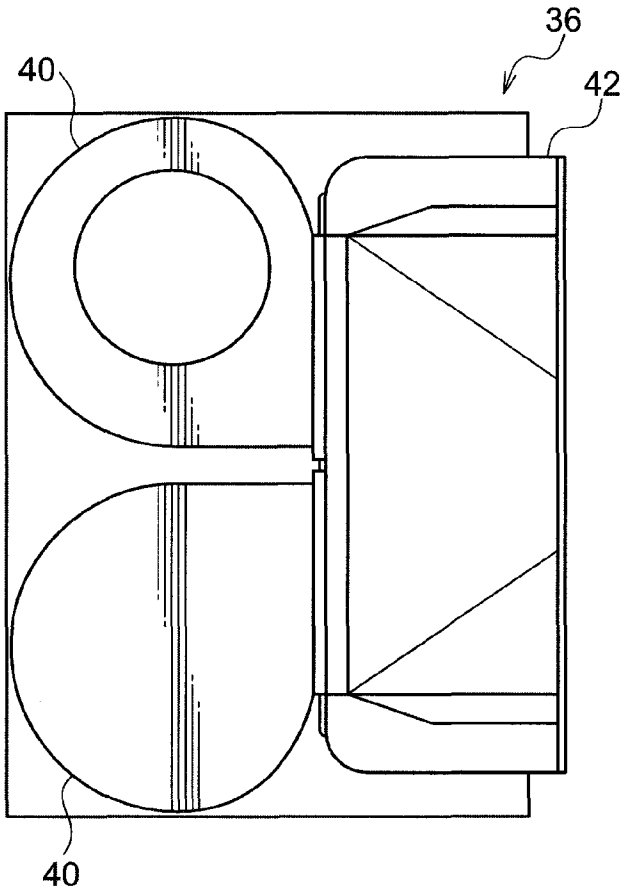
FIG. 4A is a side view of a first air blowing device employed in a paper seasoning apparatus of the first exemplary embodiment of the present invention.

As shown in FIG. 4A and FIG. 4B, each of the first air blowing devices 36 includes two air blowers 40 disposed one above the other, and a ducting section 42 for guiding the air flow generated by the air blowers 40. An opening 44 of the ducting section 42 has substantially the same height H1 as separation D1 between the mounting surface 26 and the top face 32H. This configuration provides blowing air in the paper stack housing space 34 across the height range from the mounting surface 26 to the top face 32H. More specifically, a vertical direction intermediate portion of the opening 44 of the present exemplary embodiment is shaped with a small neck portion 44S having a smaller opening cross-sectional area than that of an upper air outlet 44A and a lower air outlet 44B. This configuration provides effective blowing air from the upper air outlet 44A and the lower air outlet 44B.

Figure 5B:
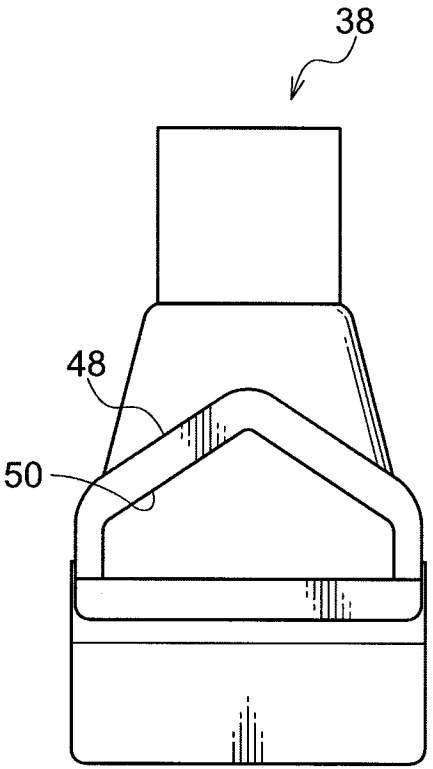
FIG. 5B is a front view of a second air blowing device employed in a paper seasoning apparatus of the first exemplary embodiment of the present invention.
Figure 5A:
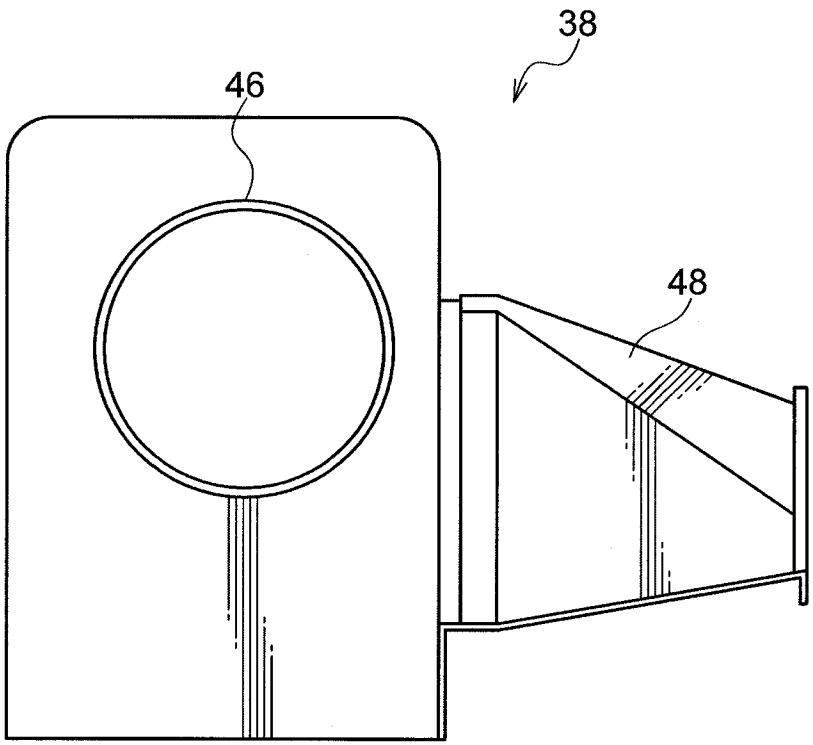
FIG. 5A is a side view of a second air blowing device employed in a paper seasoning apparatus of the first exemplary embodiment of the present invention.

As shown in FIG. 5A and FIG. 5B, each of the second air blowing devices 38 include a single air blower 46, and include a ducting section 48 for guiding air flow generated by the air blower 46. An air outlet 50 of the ducting section 48 has a lower height than the ducting section 42 of the first air blowing device 36, and the range over which air is blown by the second air blowing devices 38 is also lower in the height direction than that of the first air blowing devices 36. As shown in FIG. 3, the second air blowing devices 38 are disposed such that air can be blown in the paper stack housing space 34 including in the vicinity of the maximum height position 26T. The air outlet 50 of each of the second air blowing devices 38 is disposed at a height enabling air to be blown at the paper stack 152 at a position including the mounting surface 26.

As can be seen from FIG. 3, the plural first air blowing devices 36 and the plural second air blowing devices 38 are disposed in the present exemplary embodiment with symmetry about the center line CL. More specifically, the second air blowing devices 38 are disposed in the vicinity of the maximum height position 26T, with the air outlets 50 also disposed symmetrically in the vicinity of the maximum height position 26T. The present exemplary embodiment is disposed with an odd number of the first air blowing devices 36, with one device disposed at the width direction center (on the center line CL).

In the following explanation, when differing between the air outlets 44A, 44B and 50 of the first air blowing devices 36 and the second air blowing devices 38 is required, they will be identified by appending the reference numbers Ch1 to Ch7 in sequence along the mounting surface 26 side and then along the top face 32H side, working out from the width direction center of the mounting surface 26 side to the two edges (see FIG. 3).

Figure 6:
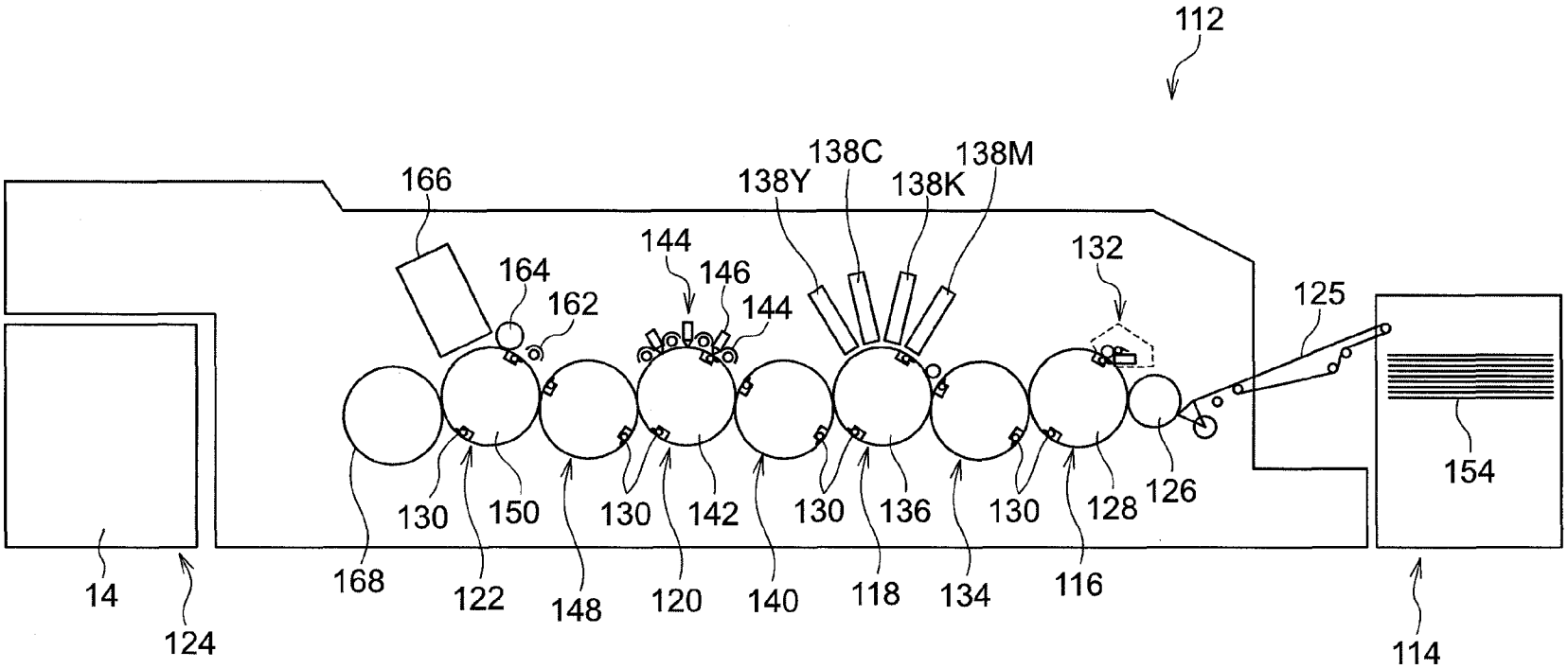
FIG. 6 is a front view illustrating a schematic configuration of an inkjet recording apparatus equipped with a paper seasoning apparatus of the first exemplary embodiment of the present invention.

FIG. 6 illustrates the inkjet recording apparatus 112 as an example of an application of the paper seasoning apparatus 12 of the present invention. The inkjet recording apparatus 112 includes a paper feeder 114, a processing liquid coating section 116, an image recording section 118, a drying section 120, a fixing section 122, and a paper discharge section 124. The inkjet recording apparatus 112 records an image on the paper 154 as the paper 154 is being conveyed along to the position of each of the above.

The paper 154 is stacked in the paper feeder 114 and the paper feeder 114 feeds out the paper 154 one sheet at a time. The paper 154 that has been fed out is conveyed via a paper feed tray 125 and a paper feed drum 126 to the processing liquid coating section 116. A processing liquid drum 128 is rotatably disposed in the processing liquid coating section 116, and the paper 154 is conveyed downstream by rotation of the processing liquid drum 128, with the leading edge of the paper 154 in a retained state by a retaining member 130. Processing liquid is coated onto the paper 154 by a processing liquid coating device 132 disposed above the processing liquid drum 128. Configuration may, as required, include a processing liquid drying apparatus to actively dry the processing liquid. The processing liquid reacts with ink, thereby acting to aggregate coloring matter (pigment) and promote separation of coloring matter (pigment) from the liquid medium.

The paper 154 is then fed via a conveying drum 134 to the image recording section 118. In the image recording section 118, the paper 154 is conveyed while retained on an image recording drum 136, and an image is recorded on a face of the paper 154 by impacting ink droplets ejected from an inkjet recording head 138 disposed above the image recording drum 136. More precisely, there are four colors of inkjet recording heads 138 in the present exemplary embodiment, for the basic colors of yellow (Y), magenta (M), cyan (C) and black (K), disposed along the circumferential direction of the image recording drum 136. Each of the inkjet recording heads 138 has an ink ejecting range corresponding to the maximum width of the paper 154, namely they are full-line heads.

The paper 154 is then conveyed via a conveying drum 140 to the drying section 120. The paper 154 is conveyed in the drying section 120 while retained on a drying drum 142. Halogen heaters 144 and warm air nozzle 146 are disposed above the drying drum 142. The ink on the paper 154 dried by heat from the halogen heaters 144 and warm air from the warm air nozzles 146 as being conveyed by the drying drum 142.

The paper 154 is then fed via a conveying drum 148 to a fixing section 122. In the fixing section 122, the image (ink) is fixed by being heated by a halogen heater 162 (preparatory heating) and pressed by a fixing roller 164, as the paper 154 is being conveyed while retained on a fixing drum 150. A check pattern on the paper 154 and the moisture content, surface temperature and glossiness are then measured by an in-line sensor 166.

The paper 154 that has been recorded with an image in the manner described above is then conveyed by a discharge roller 168, and is discharged from the inkjet recording apparatus 112 via the paper discharge section 124. The image recorded paper is then seasoned in the paper seasoning apparatus 12.

Configuration may be made such that the paper 154 is fed one sheet at a time into the paper stack housing space 34 of the paper seasoning apparatus 12, with the paper stack 152 formed by stacking the plural sheets of the paper 154 when they are in the paper stack housing space 34. Alternatively, the paper stack 152 may be formed from plural sheets of the paper 154 further upstream than the paper seasoning apparatus 12, for example, in the paper discharge section 124, and then the paper stack 152 fed as a single unit into the paper stack housing space 34 of the paper seasoning apparatus 12. Configuration may also be made such that a stack of paper is formed by hand, and the stack then set in the paper stack housing space 34 of the paper seasoning apparatus 12.

Explanation now follows regarding a method of seasoning the paper 154 by blowing air in from the side face of the paper stack 152 using the paper seasoning apparatus 12 of the present exemplary embodiment, and regarding operation of the paper seasoning apparatus 12.

For the paper stack 152 housed in the paper stack housing space 34 in the paper seasoning apparatus 12 of the present exemplary embodiment, air is blown from plural first air blowing devices 36 against a side face of the paper stack 152. Air is accordingly made to pass through between plural sheets of the paper 154 configuring the paper stack 152, enabling the paper 154 to be acclimatized to the peripheral environment (seasoned). In particular, when image recording is performed with water based ink on ordinary paper, expansion and contraction of the paper 154 readily occurs due to differences in the moisture content due to the lightness-darkness of the image (ink amount dependency) in the region over which the image is recorded (the ink ejected region). However, in the paper seasoning apparatus 12 of the present exemplary embodiment, expansion and contraction of the paper 154 may be suppressed by the effective seasoning of the paper 154. For example, when double-sided image recording is performed on the paper 154, image recording is performed on one face (the front face) and then image recording is performed on the other face (the back face). However, image recording is performed to the back face in a state in which any expansion or contraction has been eliminated (or in a state in which any expansion or contraction has been reduced) even if the paper 154 expands or shrinks immediately after performing image recording to the front face. Consequently, size mismatch and positional mismatch of the recorded image between the front face and the back face is suppressed. Even when only single sided image recording is performed on the paper 154, an improvement in the quality of recorded images may be achieved due to suppressing waviness (called curl) that occurs with such expansion or contraction of the paper 154. This also results in excellent productivity when further processing is performed after image recording, such as book binding.

In the paper seasoning apparatus 12 of the present exemplary embodiment, due to the mounting surface 26 on which the paper stack 152 is mounted being curved, even if the paper 154 were to curl, it is possible to correct the shape of the paper to make the paper 154 parallel to the air blowing direction.

Figure 7:
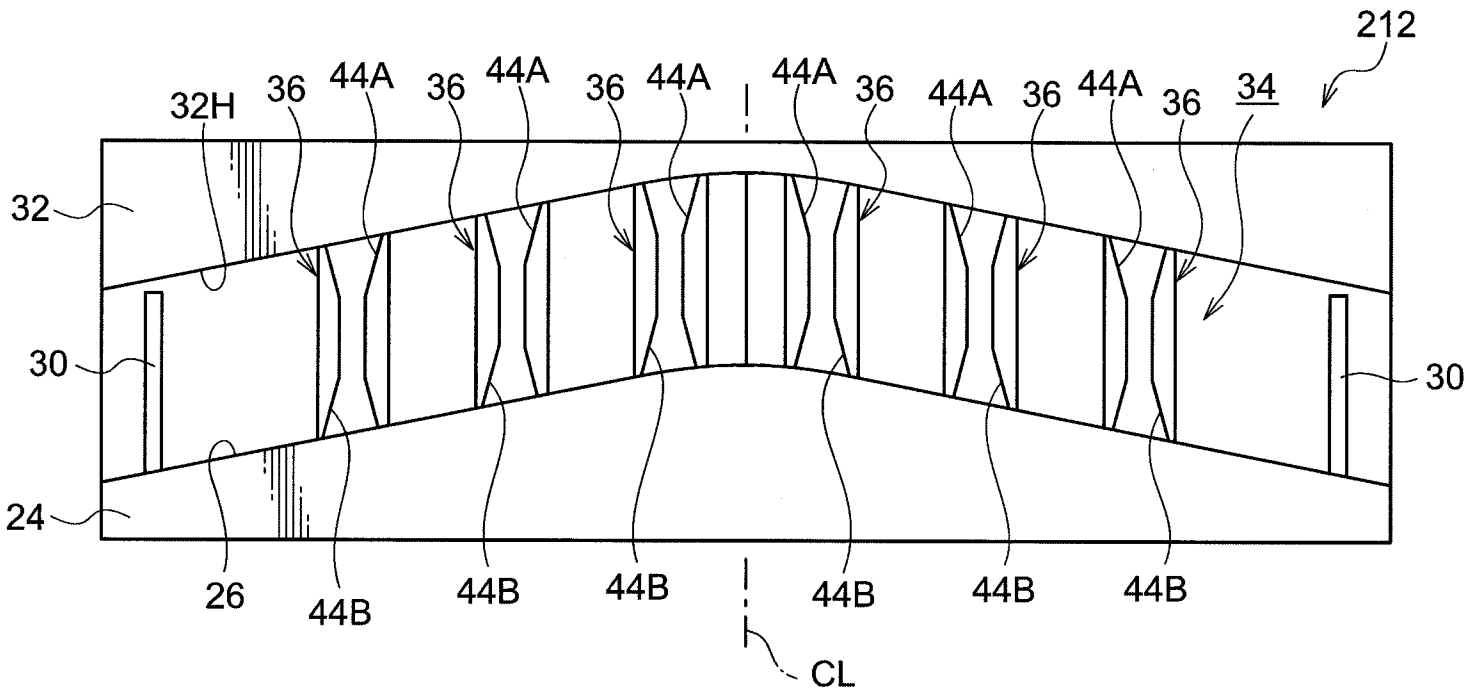
FIG. 7 is a front view illustrating a partial enlargement of a stacking shelf unit of a paper seasoning apparatus of a comparative example.
Figure 9A:
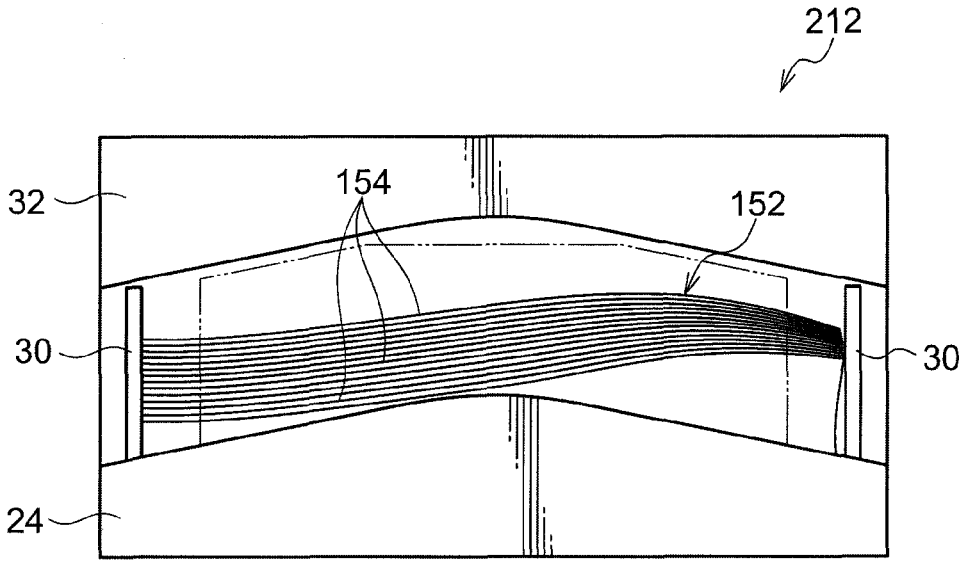
FIG. 9A is an explanatory diagram illustrating a state of paper during steady air blowing in a paper seasoning apparatus of a comparative example.

FIG. 7 illustrates, as a first comparative example, a paper seasoning apparatus 212 that lacks the second air blowing device 38, and is equipped with six of the first air blowing devices 36 alone. Configuration is also made in the paper seasoning apparatus 212 of the first comparative example with the maximum height position 26T at the width direction center of the mounting surface 26. Since air is only blown onto the paper stack 152 from the first air blowing devices 36 in the paper seasoning apparatus 212, during steady air blowing (a state in which there is a steady volume of air blown), the separation distance between the sheets of paper 154 tends to become narrower at a portion in the width direction of the paper stack 152 compared to other portions, as shown in FIG. 9A. Consequently, this leads to poor air flow between the sheets of paper 154, with this potentially leading to the paper 154 thrashing around and damage being incurred at the edges of the paper 154.

Figure 8A:
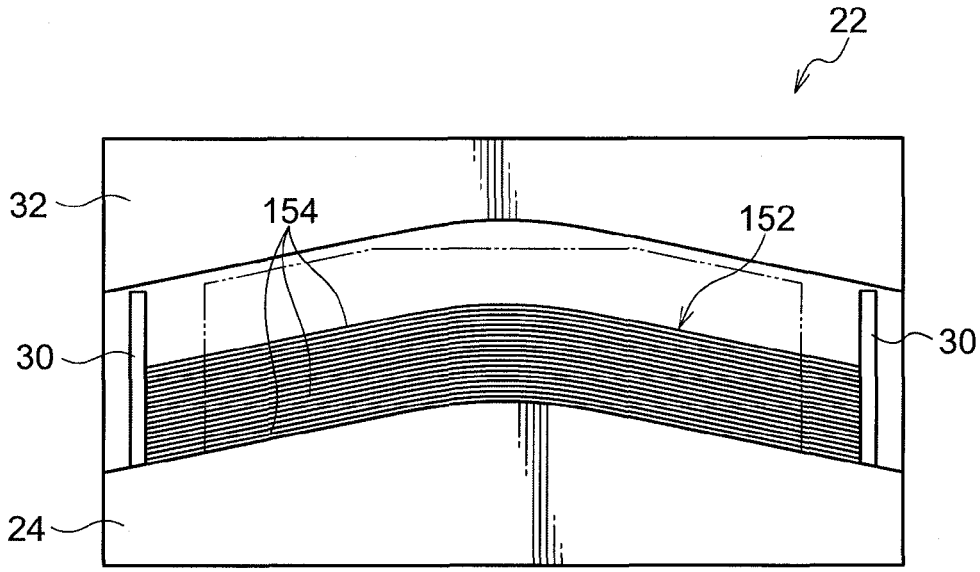
FIG. 8A is an explanatory diagram illustrating a state of paper during steady air blowing in a paper seasoning apparatus of the first exemplary embodiment of the present invention.

In contrast thereto, in the paper seasoning apparatus 12 of the present exemplary embodiment, the second air blowing devices 38 are provide in addition to the first air blowing devices 36, and the second air blowing devices 38 are disposed in the vicinity of the maximum height position 26T, at a height enabling air to be blown against the paper stack 152 at a position including the mounting surface 26. Consequently, as shown in FIG. 8A, the separation between the sheets of paper 154 configuring the paper stack 152 is made more even along the width direction during steady air blowing than in the first comparative example. Namely, sufficient volume of air can be sent to the width direction central portion, thereby enabling unevenness in moisture content remaining in the paper 154 to be suppressed. The paper 154 may also be suppressed from thrashing around.

Figure 9B:
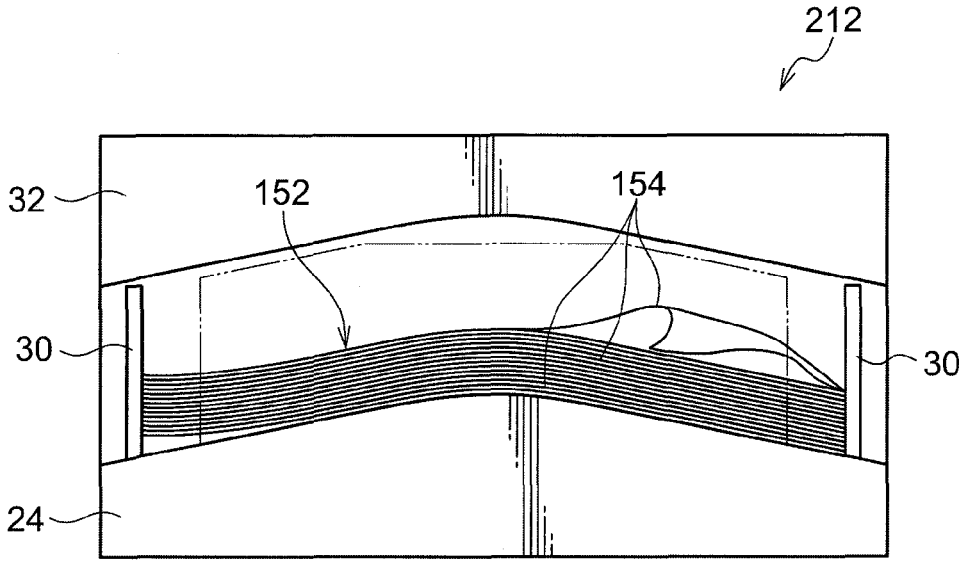
FIG. 9B is an explanatory diagram illustrating a state of paper at the start of air blowing in a paper seasoning apparatus of a comparative example.

There is no particular limitation to the timing with which to start blowing air from each of the channels, and configuration may be made such that air blowing is started from all of the channels at the same time. However, when air is first blown from the first air blowing devices 36 and there is a wide separation between the paper stack 152 and the top face 32H, as shown in FIG. 9B, this potentially leads to the edge portion of the uppermost sheets of paper 154 curling over on itself.

Figure 8B:
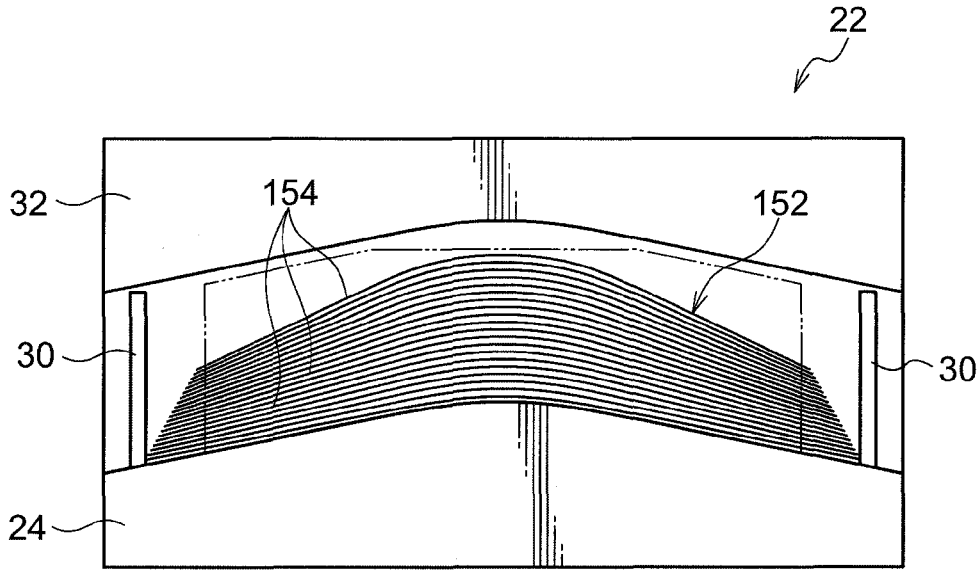
FIG. 8B is an explanatory diagram illustrating a state of paper at the start of air blowing in a paper seasoning apparatus of the first exemplary embodiment of the present invention.

However, timing may be set such that air blowing is started from the second air blowing devices 38 (Ch 2), and then air blowing is started the other channels (for example, starting air blowing may be in the sequence Ch2, Ch1, Ch3, Ch5, Ch6, to Ch7). In such as case, as shown in FIG. 8B, due to configuration with the maximum height position 26T, a greater volume of air flow can be fed at the start of air blowing to the width direction central section that is susceptible to narrowing of the separation between the sheets of paper 154. Accordingly, not only may the spacing between the sheets of paper 154 be widened in the vicinity of the maximum height position 26T, but the paper 154 may also be maintained in a good shape, and paper curl may be suppressed.

In the paper seasoning apparatus 12 of the first exemplary embodiment, while configuration may be made such that there is a uniform volume of air blown from each of the channels, configuration may also be made such that the volume of air at the channels on the width direction edges is less than the volume of air of the channels at the width direction center. Table 1 illustrates examples of airflow volume patterns from each of the channels in the paper seasoning apparatus 12. In the first pattern, the volume of air flowing in the channels at the width direction edges is set less than the volume of air flowing in the channels at the width direction center, as described above. In the second pattern the volume of air flowing in the upper channel (Ch 5 to Ch 7) is set at less than the volume of air flowing in the lower channels (Ch 1 to Ch 4).

In the second pattern, since air is also blown in the vicinity of the maximum height position 26T by the second air blowing device 38, an effect is achieved of evening out the separation between the sheets of paper 154 along the width direction. The volume of air blown in the vicinity of the maximum height position 26T (the width direction center) through the channels (Ch 1, 2, 3 and 5) is greater than that in the other channels (Ch 4, 6, 7) in the first pattern. Due thereto, the first pattern achieves even greater uniformity in separation between the sheets of paper 154, suppresses unevenness in moisture content, and raises the effectiveness with which the paper 154 is suppressed from thrashing about.

TABLE 1

| | Ch 1 | Ch 2 | Ch 3 | Ch 4 | Ch 5 | Ch 6 | Ch 7 |
|---|---|---|---|---|---|---|---|
| First Pattern | 100 | 100 | 100 | 60 | 100 | 80 | 30 |
| Second Pattern | 90 | 90 | 90 | 90 | 70 | 70 | 70 |

Figure 10:
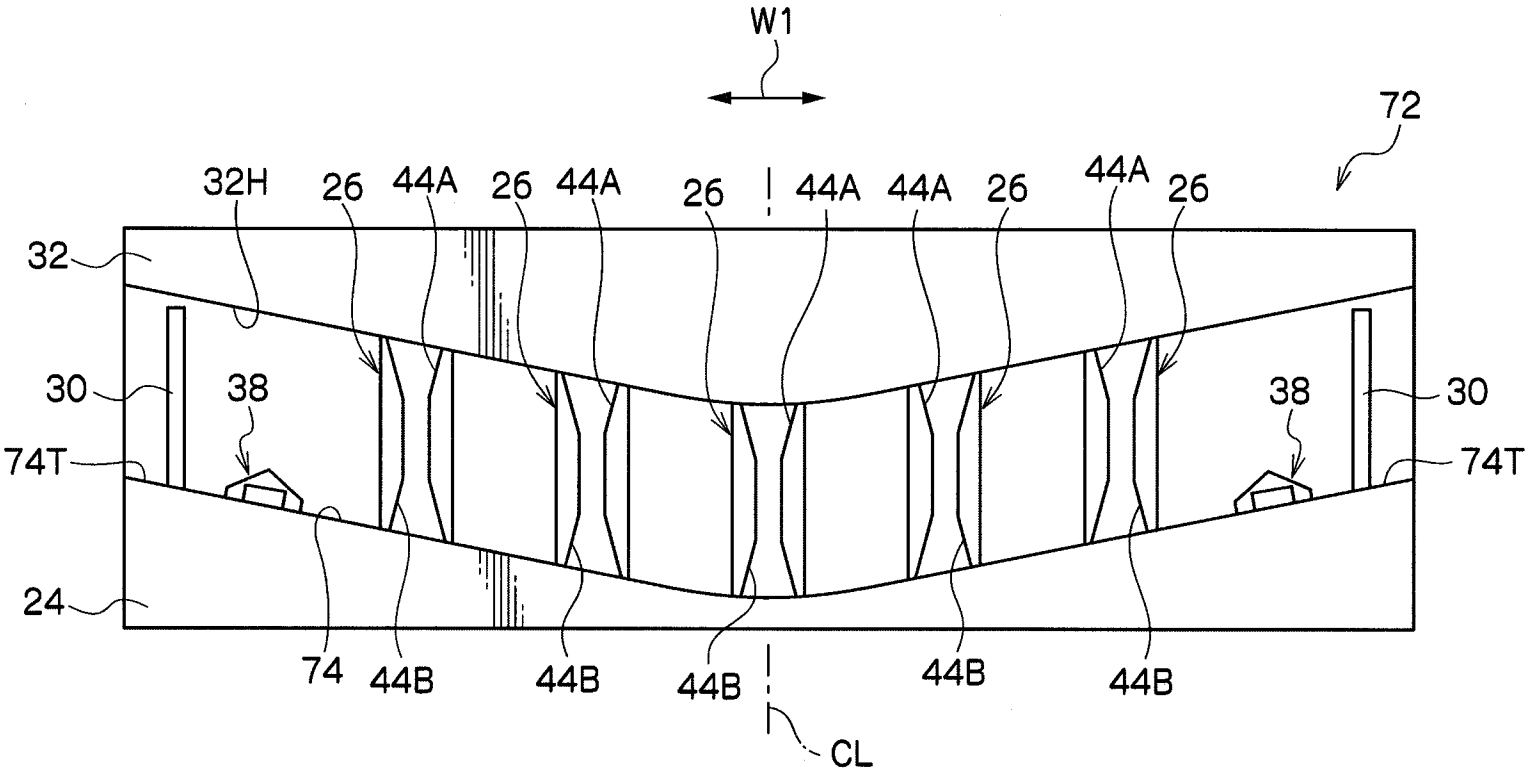
FIG. 10 is a front view illustrating a partial enlargement of a stacking shelf unit of a paper seasoning apparatus of a second exemplary embodiment of the present invention.

FIG. 10 illustrates a paper seasoning apparatus 72 of a second exemplary embodiment of the present invention. Portions that differ from the first exemplary embodiment will be explained below, with configuration elements the same as those of the first exemplary embodiment allocated the same reference numbers, and therefore detailed explanation will be omitted. Further explanation regarding an inkjet recording apparatus applied with the paper seasoning apparatus 72 of the second exemplary embodiment will be omitted, since the overall configuration is similar to that of the first exemplary embodiment.

In the paper seasoning apparatus 72 of the second exemplary embodiment, a mounting face 74 on top of the mounting plate 24 is shaped in an opposite manner to that of the first exemplary embodiment, to have a lowered width direction central portion and be raised at both width direction edges, in a downwards facing protruding shape. Accordingly, maximum height positions 74T are configured at both edges in the width direction of the mounting face 74.

In the second exemplary embodiment, the second air blowing devices 38 is aligned with the shape of the mounting face 74 and disposed at either width direction edge portion so as to be disposed in the vicinity of the maximum height positions 74T.

Similar operation and effect to that of the paper seasoning apparatus 12 of the first exemplary embodiment is exhibited by the paper seasoning apparatus 72 of the second exemplary embodiment configured as described above. More specifically, since air is blown against the side face of the paper stack 152 by the second air blowing devices 38 in the vicinity of the maximum height positions 74T, it is possible to achieve more uniformity in the separation between the sheets of paper 154 configuring the paper stack 152. Unevenness in moisture content remaining in the paper 154 and thrashing about of the paper 154 can be suppressed by also feeding sufficient volume of air to both width direction edges.

In both the paper seasoning apparatus 12 of the first exemplary embodiment and the paper seasoning apparatus 72 of the second exemplary embodiment, the first air blowing devices 36 are disposed with left-right symmetry about the center line CL at the center, and the second air blowing devices 38 are also disposed with left-right symmetry. Accordingly, it is possible to make the separation between the sheets of paper 154 more uniform along the width direction than configurations with the first air blowing devices 36 or the second air blowing devices 38 disposed asymmetrically in the left-right direction. In particular, due to the first air blowing device 36 being provided with the height of the opening 44 spanning from the mounting plate 24 to the top plate 32, action to make the separation between the sheets of paper 154 more even in the width direction can be efficiently exhibited even for high heights of the paper stack 152 (paper stack 152 configured from a large number of sheets of paper 154). The second air blowing devices 38 are set with the height of the air outlets 50 at positions including the mounting surface 26, and so action to make the separation between the sheets of paper 154 more even in the width direction may be efficiently exhibited on the sheets of paper 154 configuring the bottom of the paper stack 152.

What is claimed is:

1. A paper seasoning apparatus comprising:

a mounting plate including a curved mounting face on which a paper stack is mounted;

a plurality of first air blowing sections that blow air against a side face of the paper stack mounted on the mounting face from a direction orthogonal to the curved direction of the mounting face; and a plurality of second air blowing sections that have an air blowing range shorter in the height direction than the first air blowing sections, and that blow air to the vicinity of maximum height position(s) of the mounting face.

2. The paper seasoning apparatus of claim 1, wherein the air blowing range of the second air blowing section includes the mounting face.

3. The paper seasoning apparatus of claim 1, wherein the mounting face is configured with a curved shape when viewed along the air blowing direction from the first air blowing sections having a central portion protruding upwards, and dropping downwards on progression towards both edge portions, to give the maximum height position at the center of the mounting plate.

4. The paper seasoning apparatus of claim 3, wherein the plurality of first air blowing sections are disposed symmetrically about the central portion of the mounting face as the center.

5. The paper seasoning apparatus of claim 3, wherein the plurality of second air blowing sections are disposed symmetrically about the central portion of the mounting face as the center.

6. The paper seasoning apparatus of claim 3, further comprising a top plate including a top face that faces the mounting face and has a curved shape similar to the mounting face.

7. The paper seasoning apparatus of claim 1, wherein the mounting face is configured with a curved shape when viewed along the air blowing direction from the first air blowing sections having a central portion protruding downwards, and rising upwards on progression towards both edge portions, to give the maximum height positions at both edges of the mounting plate.

8. The paper seasoning apparatus of claim 7, wherein the plurality of first air blowing sections are disposed symmetrically about the central portion of the mounting face as the center.

9. The paper seasoning apparatus of claim 7, wherein the plurality of second air blowing sections are disposed symmetrically about the central portion of the mounting face as the center.

10. The paper seasoning apparatus of claim 7, further comprising a top plate including a top face that faces the mounting face and has a curved shape similar to the mounting face.

11. The paper seasoning apparatus of claim 1, wherein volume of air blown by the first air blowing section disposed at the vicinity of the maximum height position of the mounting face is greater than the volume of air blown by the other first air blowing sections.

12. A paper seasoning method that utilizes the paper seasoning apparatus of claim 1 to blow air onto a side face of a paper stack mounted on the mounting plate, wherein volume of air blown by the first air blowing section disposed in the vicinity of the maximum height position of the mounting face is set greater than the volume of air blown by the other first air blowing sections.

13. A paper seasoning method that utilizes the paper seasoning apparatus of claim 1 to blow air onto a side face of a paper stack mounted on the mounting plate, wherein air starts to be blown from the first air blowing section after air blowing from the second air blowing section(s) has started.

14. An inkjet recording apparatus comprising:

an inkjet recording apparatus main body that jets ink droplets onto paper and records an image; and the paper seasoning apparatus of claim 1 provided at a discharge section for paper on which an image has been recorded by the inkjet recording apparatus main body.

* * * * *